US005312244A

United States Patent [19]

Marchand et al.

[11] Patent Number: 5,312,244

[45] Date of Patent: May 17, 1994

[54] BURNER WITH GRILLE AND HEATING INSTALLATION FITTED WITH SUCH A BURNER

[75] Inventors: Bernard Marchand, Paris; Philippe Morand, Livry Gargan, both of France

[73] Assignee: Gaz de France, Paris, France

[21] Appl. No.: 993,242

[22] Filed: Dec. 17, 1992

[30] Foreign Application Priority Data

Dec. 20, 1991 [FR] France ..... 91 15888

[51] Int. Cl.[5] ..... F23Q 9/00

[52] U.S. Cl. ..... 431/285; 431/328; 126/360 R

[58] Field of Search ..... 431/278, 285, 328, 174, 431/179; 126/360 R

[56] References Cited

U.S. PATENT DOCUMENTS 4,083,355 4/1978 Schwank ..... 431/285

4,583,938 4/1986 Fardeau et al. ..... 126/360 R

*Primary Examiner*—Carroll B. Dority

*Attorney, Agent, or Firm*—Pollock, VandeSande & Priddy

[57] ABSTRACT

Gas burner comprising a gas distribution chamber (3) fed with combustive air and combustible gas and communicating with a combustion chamber (15) through a main flame stabilization grille (11) having a lacunar structure, porous to the air/gas mixture. Preferably, the means (23) for ignition of the burner will be disposed outside the distribution chamber but will pass through the grille (11), the ignition being carried out either from one side of this grille, or from its periphery.

9 Claims, 3 Drawing Sheets

BURNER WITH GRILLE AND HEATING INSTALLATION FITTED WITH SUCH A BURNER

FIELD OF THE INVENTION

The invention relates to a burner with a mixture of gases and with combustion grille(s) usable in particular on immersed tube heating installations.

BACKGROUND OF THE INVENTION

Many heating units for industrial baths are known today using the technique of compact immersed tubes.

Often, these units use burners termed "mixing at the nozzle", that is to say without distribution, the combustion being effected directly in the zone where the air and the gas meet.

Experience has, however, shown, that this type of burner is not totally satisfactory in particular on installations with compact immersed tubes and often leads to an excessive production of carbon monoxide and to a noisy operation due in particular to turbulence problems.

The Applicant has already proposed, particularly for this type of problem, some solutions, one of which is set forth in French Patent Application FR-A-2,606,492 filed on 7 Nov. 1986.

BRIEF DESCRIPTION OF THE INVENTION

With a permanent view to improvement, the Applicant now proposes an improved combustion and heating installation, yet more reliable and easier to maintain, taking into account the growing requirements in this connection.

This equipment makes it possible, moreover, to increase the overall efficiency of the installation by increasing the intrinsic performance of the burner.

The solution proposed in the invention consists, in particular, in that the grille of this burner has passing through it not only the said first apertures, but also second apertures of smaller cross-section giving the grille a lacunar structure, porous to the air/gas mixture which thus circulates through these two series of apertures.

Advantageously, these apertures will be distributed over substantially the entire surface of the grille, the number of the second apertures being much larger than that of the first, so that, when the burner is operating, the flames developed in the combustion chamber comprise tongues of relatively long length substantially in the extension of the first apertures and a zone of relatively short flames, distributed opposite the said second apertures.

In this manner, the combustion efficiency should be optimum and the conventional problems of flame stability distinctly less serious.

A priori, the grille may be constructed from the materials and structures belonging to the following list: sintered bronze or stack of finely perforated metal sheets, fibrous ceramic, metal fabric.

According to another feature of the invention, the burner will further comprise, advantageously, means for ignition and for monitoring flames disposed beside the distribution chamber and emerging into the combustion chamber.

Preferably, these ignition and monitoring means receive the flow of mixture necessary for the ignition via an ignition chamber isolated or separated from the distribution chamber with independent or autonomous feeds in order to permit air/gas quantities appropriate to each of these chambers.

For the ignition of the burner, it will be possible to have recourse either to a local ignition offset towards the outside of the main grille, or to a peripheral ignition by a zone of flames then bordering the periphery of the combustion chamber.

In order to promote the long-term mechanical strength especially of the main grille in the face of thermal stresses in particular, another feature of the invention provides for the disposition of a turbine for mixing the gases in the distribution chamber.

In addition to the burner which has just been presented, the invention also relates to an installation for heating a bath of liquid heated by such a burner, the combustion chamber of which, immersed in the said bath, is connected to at least one exchanger tube also immersed in this bath and in which may circulate, before their discharge, the combustion products generated by the burner.

BRIEF DESCRIPTION OF THE FIGURES

In what follows, one embodiment of the invention will now be described in a more detailed manner, reference being made therefore to accompanying drawings given solely as non-limitative examples, in which.

DETAILED DESCRIPTION OF THE INVENTION

Figure 1:
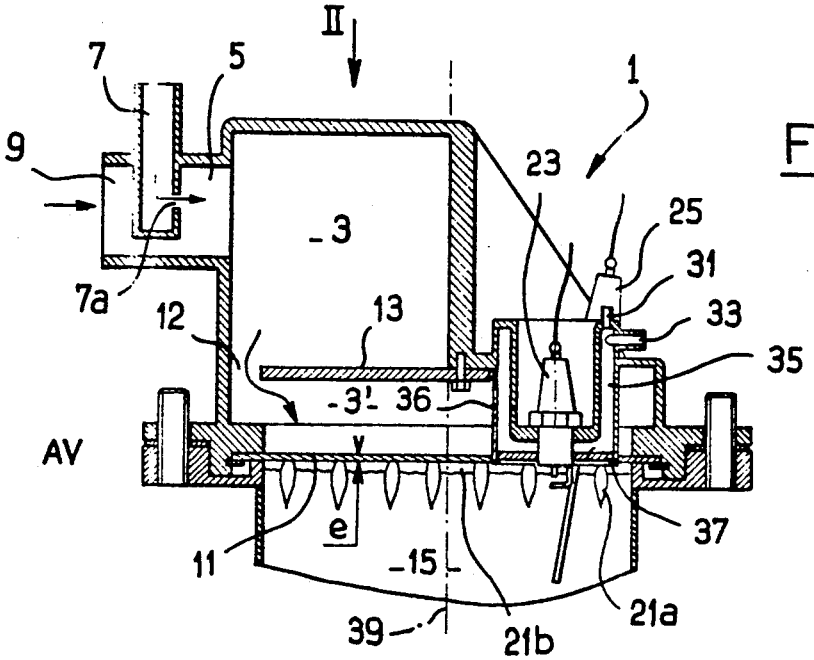
FIG. 1 is a local diagrammatic view of the burner of the invention in cross-section along the line I—I of FIG. 2.
Figure 2:
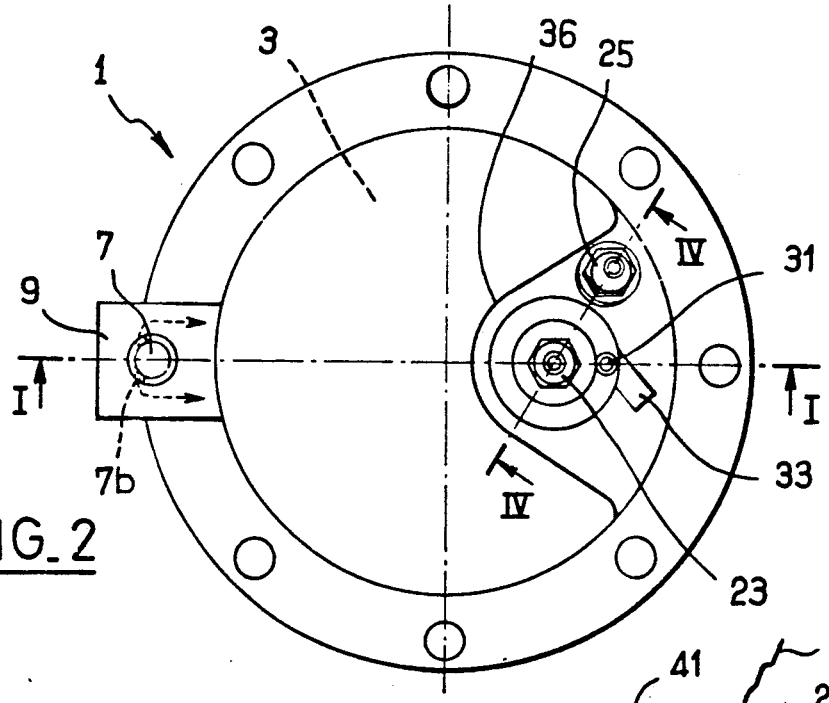
FIG. 2 is a plan view of the same burner in the direction of arrow II of FIG. 1.

Referring first of all to FIGS. 1 and 2, the burner, designated as a whole by the reference 1, comprises a distribution chamber (also termed "premixing chamber") into which emerges, through a preferably radial aperture 5, the combustive air and the combustible gas which begin to mix.

Referenced as 7 is the inlet of combustible gas, the flow of which is directed, via at least one front 7*a*, or back 7*b*, transverse aperture (FIG. 2), substantially parallel to the flow of air under pressure (blown air) which arrives through the radial duct 9.

The distribution chamber 3, which has the general shape of a cylindrical box of substantially circular cross-section, is limited transversely on its front face (AV) by a flame stabilization grille 11 through which the air and gas mixture passes, after passage of the latter through a distribution baffle or channel 12 defined or limited by a plate or any other transverse obstacle 13 conducive to the homogeneous mixing of the gases.

The grille 11 has the function of ensuring a suitable distribution and a good stabilization of the flames at the entry to the combustion chamber 15 where these flames will develop.

Figure 3:
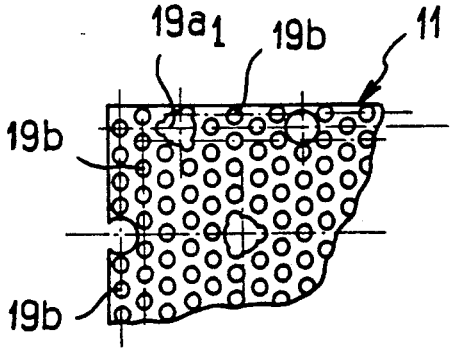
FIG. 3 is a magnified local plan view of a porous grille usable in the context of the invention.

In order to promote this, and as is seen more clearly in FIG. 3, this grille, which has here the general shape of a substantially flat plate, has been constructed to have passing through it, over its thickness e, through preferably two series of apertures comprising first apertures 19a of relatively wide cross-section (several $mm^2$) and second apertures 19b of more reduced cross-section giving the grille a lacunar structure, porous to the air/-gas mixture.

In practice, these two series of apertures will advantageously be distributed over substantially the entire active surface of the grille. And the number of the second apertures 19b for diffusion will be much larger than that of the main apertures 19a, for example in a ratio substantially comprised between 15 to 1 and 30 to 1. As for the cross-section of these second apertures 19b, it will preferably be 2 to 4 times smaller than that of the first apertures 19a.

In this manner, when the burner is operating, the flames developed in the combustion chamber (the cross-section of which will preferably be slightly less than that of the grille) will comprise tongues 21a of relatively long length extending substantially in the extension of the first apertures 19a, whereas a general zone of relatively short flames 21b will be distributed opposite the second apertures 19b.

In practice, the grille may in particular be constructed from materials and structures of the sintered bronze type or of the stack of finely perforated metal sheets type or else of fibrous ceramic or of metal fabric.

For example, in the context of a grille of sintered bronze, provision may be made to use a plate of this material about 3 mm thick, pierced by holes of 2 mm cross-section at a square pitch of 8 mm, the degree of empty space corresponding to these drillings being of approximately 3 to 8%.

Tests have shown that such a grille, the power of which, represented by the small diffusion apertures 19b represented about 30 to 40% of the total power, functioned very well.

It will be noted that an additional advantage of such a structure is that of ensuring the internal cooling thereof by circulation through it of the air/gas flow.

Provision could even be made for some of the second apertures 19b, advantageously arranged substantially regularly across the surface of this grille, to open randomly onto one main aperture 19a or another, thus increasing the cross-section of the latter, as is shown for example at the location of the aperture $19a_1$ of FIG. 3.

Figure 4:
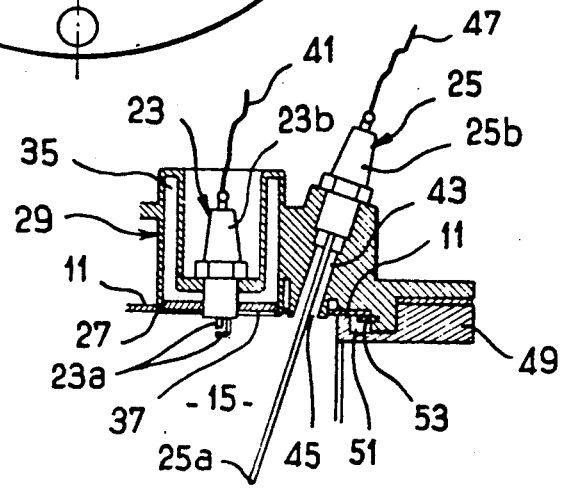
FIG. 4 is another local view of the burner of the invention along the line of cross-section IV—IV of FIG. 2.

Returning to the structure of the burner of FIGS. 1, 2 or 4, it will be further noted that it comprises, in a conventional manner, ignition means 23 serving to trigger the combustion, as also means 25 for monitoring the presence of the flames.

The ignition means may, for example, consist of a plug, of the automobile sparking-plug type, mounted through the main grille 11.

Like the monitoring means 25, these ignition means will preferably be disposed outside, beside the distribution chamber 3.

More precisely, the igniter 23 may be disposed at the location of a passage 27 (see FIG. 4) made on one side, through the grille 11, this passage receiving part of the head of the burner forming igniter support 29 fitted with autonomous inlets of combustible gas 31 and combustive air 33 (see FIGS. 1 and 2), so as to feed an ignition mixing chamber 35. This chamber, preferably separated or isolated from the distribution chamber by a wall 36, may communicate with the combustion chamber 15 through an additional grille 37 for stabilizing the ignition flame, this grille then extending substantially parallel to the plane of the main grille 11 and having passing through it the igniter 23, so that the electrodes 23a of the latter emerge into the combustion chamber 15 in order to ignite the mixture therein.

Thus disposed, the igniter 23 will extend preferably substantially parallel to the general axis 39 of the chamber 15, somewhat towards the periphery of the grille 11.

As for the ignition chamber 35, it may have, at the top part, the shape of an annular, hollow vertical column, surrounding a central cavity open to the free air of the igniter support, the head 23b of the igniter with its supply cable 41 extending in this central cavity. In addition, by virtue of a tangential supply of air at its upper part, this same chamber will provide a mixture by rotary mixing of the gases until they encounter, at the lower part, the transverse grille 37 at the place where the ignition chamber resumes the shape of a disc.

In order to monitor the presence of the flames in the combustion chamber, the burner may then, in addition, be equipped with a monitoring means 25, the probe of which, constituted for example by a preferably rectilinear electrode 25a, will extend into the zone of development of the flames holding respectively to the main grille 11 and to the secondary grille 37 for ignition, as is clearly shown in FIG. 4.

Thus disposed, the monitoring means 25 may pass through a well 43 itself passing through a second passage 45 made through the main grille 11, so that the probe 25a can communicate with the combustion chamber 15, the head 25b of this monitoring means with its electrical supply cable 47 remaining, of course, aside from the combustion zone so as to be cooled by the ambient air.

By comparing FIGS. 1 and 4, it will also be noted that the main grille 11 will advantageously be maintained at its periphery by a flange 49 extending externally, substantially at the level of the connection capable of being detached between the upper part of the burner comprising the distribution chamber 3 and the lower part comprising the combustion chamber 15.

In order to do this, the flange 49 will define locally an annular cavity 51 outside the chambers 3 and 15. In this cavity, a retaining means 53, such as a circlip, will be capable of maintaining with some possible clearance the peripheral edge of the grille 11.

Thus, the maintaining zone of this grille will be relatively isolated thermally from the hot part of the burner and the grille will be capable of absorbing more easily the thermal stresses.

Figure 5:
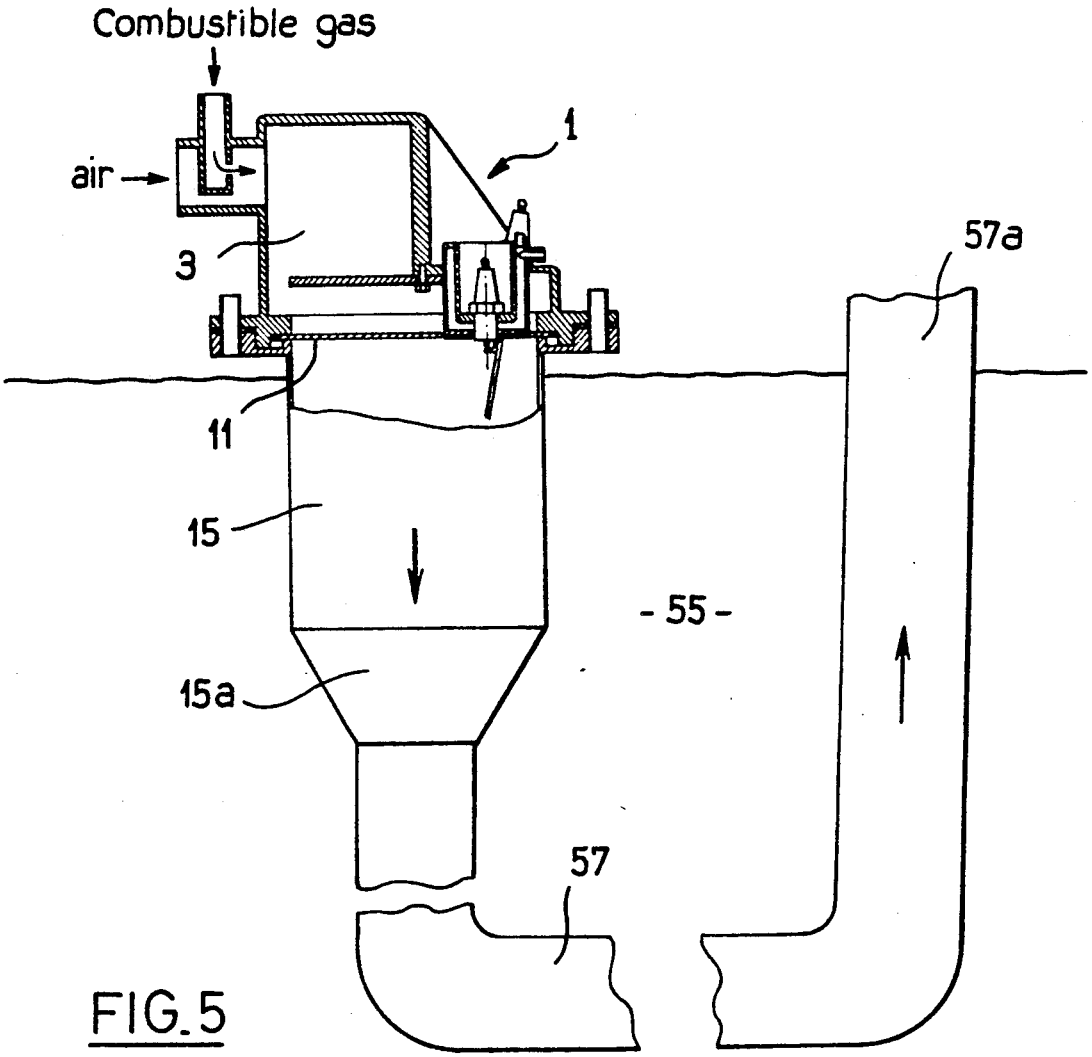
FIG. 5 is a diagrammatic view of the burner of the invention used on an installation with compact immersed tube.

Reference will now be made to FIG. 5, in order to describe briefly the privileged application of the burner of the invention to the heating of an industrial bath of liquid 55 in which are immersed at least the combustion chamber 15 of the burner and a heat exchanger tube 57 connected to the, outlet 15a of the combustion chamber 15 and which extends in the bath 55, which is heated by thermal exchange with the combustion products generated by the burner and circulating in the tube before being discharged towards the outlet 57a of this same tube emerging outside.

Figure 6:
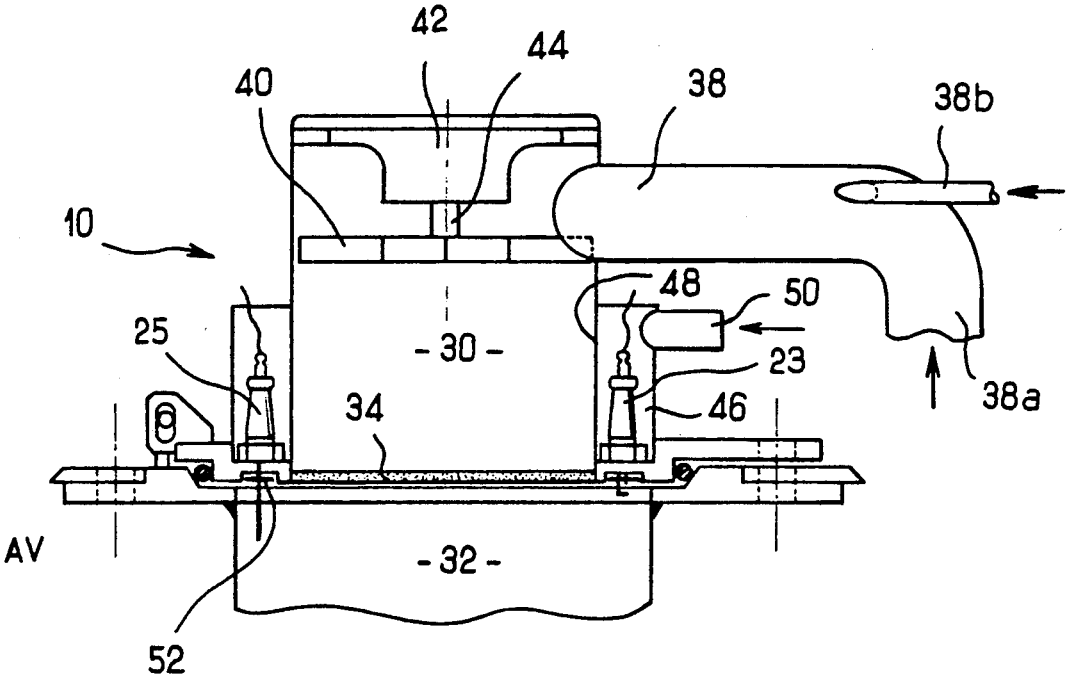
FIG. 6 shows a variant embodiment.

FIG. 6 shows a variant embodiment of the burner of the invention, which is characterized by a mixing turbine and a peripheral ignition.

This burner, referenced 10 comprises, like the preceding burner, a distribution chamber 30 communicating with a combustion chamber 32 through a main combustion grille 34 of the same type as the preceding grille (11).

The distribution chamber 30 is here supplied tangentially with air and combustible gas (preferably already at least partially mixed) via an admission pipe 38 which may be exited upstream of the air inlet 38*a* onto which is connected the gas inlet 38*b*.

In order to improve the quality of the combustion and to promote a good resistance to thermal stresses of the grille 32, there is disposed facing the latter, in the chamber 30, a mixing turbine 40. It has seemed preferable to place this turbine substantially at the level of the zone, opposite to the grille, where the lateral pipe 38 connects tangentially to the chamber 30.

In this manner, the turbine blades will he capable of transversely receiving the gaseous mixture and of thus being naturally driven in rotation creating recirculation currents conducive to the homogenization the gases and to the limitation of the thermal stresses.

A boss 42 located, in FIG. 6, towards the top of the chamber 30 supports the rotation shaft 44 of the turbine which can turn in a conventional manner thereon, via ball bearings (not shown).

For the ignition of the burner, the solution retained here consists in a "peripheral" ignition, via an ignition chamber 46 extending all around the distribution chamber 30, a priori essentially in its front part (AV).

In order in particular for it to be possible to regulate at will and in an autonomous manner the air and the gas feeding the distribution and ignition chambers respectively, it seemed once again preferable to "isolate" them from one another by a separating partition 48 and to provide the ignition chamber 46 with its own inlet of mixture, via a tangential supply pipe 50.

And, in order to hold the ignition flame, a secondary combustion grille 52 has also been interposed between the ignition chamber and the combustion chamber.

The distribution chambers and ignition chambers being preferably disposed concentrically, this secondary grille may in particular have the shape of a frame or of a ring surrounding the main grille.

Such a disposition is advantageous.

In fact, if the abovementioned means 23, 25 for ignition and for monitoring flames are mounted in the chamber 46, so that they pass through the grille 52, in order to emerge into the chamber 32, it will be possible not only to ensure an effective peripheral ignition, but also to improve the monitoring conditions by limiting the thermal stresses sustained by these accessories. For this it will be sufficient, when the ignition sequence of the burner starting cycle is completed and the latter is kept alight by virtue of the detection of the flames, to shut off the supply of gas to the chamber 46 while maintaining its supply of air.

The flames holding as far as the secondary grille 52 will then be extinguished. The air, however, will continue to escape though this grille towards the combustion chamber, this airflow thus constituting an excellent means for continuous cooling at least of the plug 23 and of the monitoring electrode 25.

It will be noted that this principle of blowing air after ignition is quite adaptable to the case of the burner of FIGS. 1 to 5. Similarly, the principle of the peripheral ignition could be retained on this burner, it thus being possible for the ignition chamber 46 with its accessories to surround the base (reference 3' in FIG. 1) of the distribution chamber 3.

We claim:

1. A gas burner comprising:

means forming a first chamber into which a first supply of air and combustible gas is introduced for mixing;

means forming a second chamber located adjacent to the first chamber and sealed off therefrom for receiving a second supply of air and combustible gas that becomes mixed therein;

means for supplying separate mixtures of air and combustible gas to the first and second chambers;

means forming a third chamber located opposite the first and second chambers for combusting mixed air and combustible gas passed from either the first or second chambers;

a first flame stabilizing porous plate, separating the first and third chambers;

a second flame stabilizing porous plate separating the second and third chambers, the first and second plates located in near coplanar adjacent relation;

electrical ignition means located in the second chamber and extending through the second plate into the third chamber, the ignition means having a spark gap disposed in the third chamber for igniting the air and combustible gas mixture passed from the second chamber, through the second plate, to the third chamber, and subsequently igniting the air and combustible gas mixture passed from the first chamber, through the first plate, to the third chamber.

2. The gas burner set forth in claim 1 wherein the means for supplying the air and combustible gas mixture to the second chamber comprises a conduit tangentially oriented relative to the second chamber for improving the mixing therein.

3. The burner set forth in claim 1 wherein the first plate includes a first centrally offset opening for receiving the second plate.

4. The burner set forth in claim 1 wherein the first plate includes a second centrally offset peripheral opening for receiving a heat sensor which extends therethrough to the third chamber for monitoring the combustion therein.

5. The burner set forth in claim 1 further comprising:

an annular recess formed in a housing of the burner for receiving the periphery of the first plate; and an annular flange for clamping a radially outward portion of the first plate to a mating portion of the burner housing.

6. The burner set forth in claim 1 wherein the first plate comprise:

first apertures having a first cross sectional area; and second apertures having a second cross sectional area smaller than the first by a ratio in the range of approximately 1:2 to 1:4;

wherein flames developed in the third chamber include flames of a relatively long length extending from the first apertures, and flames of a smaller length extending from the second apertures.

7. The burner set forth in claim 1 wherein the first plate is manufactured from a material selected from the group consisting of: sintered bronze, perforated sheet metal, fibrous ceramics, and woven metal fabrics.

8. The burner set forth in claim 1 wherein the first chamber encloses a turbine for promoting the flow of mixed combustible gas and air from the first chamber, and decreasing thermal stress on the first plate.

9. The burner set forth in claim 1 wherein the second chamber is annular and is located radially outwardly of the first chamber, thereby causing ignition of the air and gas mixture, passing through the second plate, in a corresponding annular volume of the third chamber.

* * * * *